United States Patent [19]

Noguchi et al.

[11] 4,244,341

[45] Jan. 13, 1981

[54] FUEL INJECTION SYSTEM FOR AN INTERNAL COMBUSTION ENGINE

[75] Inventors: Masaaki Noguchi, Nagoya; Yukiyasu Tanaka, Okazaki; Taro Tanaka, Chiryu, all of Japan

[73] Assignee: Nippon Soken, Inc., Nishio, Japan

[21] Appl. No.: 893,533

[22] Filed: Apr. 4, 1978

[30] Foreign Application Priority Data

Apr. 7, 1977 [JP] Japan ..... 52-40126

[51] Int. Cl.[3] ..... F02M 41/06

[52] U.S. Cl. ..... 123/449

[58] Field of Search ..... 123/139 BC, 139 BE, 123/139 AW

[56] References Cited

U.S. PATENT DOCUMENTS

| | | | |
|---|---|---|---|
| 2,161,507 | 6/1939 | Egersdörfer | 123/139 BC |
| 2,633,187 | 3/1953 | Smith, Jr. | 123/139 BC |
| 2,955,583 | 10/1960 | Dahl et al. | 123/139 BC |
| 3,993,033 | 11/1976 | Chattopadhayay et al. | 123/139 BC |
| 3,996,910 | 12/1976 | Noguchi et al. | 123/139 BC |

*Primary Examiner*—Charles J. Myhre
*Assistant Examiner*—Andrew M. Dolinar
*Attorney, Agent, or Firm*—Cushman, Darby & Cushman

[57] ABSTRACT

A metering and distribution device for a fuel injection system of an internal combustion engine includes a housing with a fuel inlet port connected to a fuel pump and a circumferential row of fuel outlet ports respectively connected to fuel injectors for respective engine cylinders. A rotor, rotatably mounted in the housing, is provided with an orifice and rotates in a timed manner with the engine. A control member is telescopically mounted on the rotor and moves axially thereon in accordance with variations in the flow rate of intake air and has a circumferential row of orifices equal to the fuel ports and cylinders. The inner member, whether the rotor or control member, has an axially extending fuel passage connected to the inlet port and the rotor's rotation moves the rotor's orifice into overlapping communication with successive orifices in the control member and thus to fuel outlet ports and respective cylinders. The angle of the rotor's rotation during which communication between the rotor's orifice and each control member orifice lasts is varied in accordance with variations in the flow rate of engine intake air thereby accurately metering fuel charges to respective cylinders. Orifice members of substantially the same flow characteristic are removably mounted in respective fuel outlet ports to provide fixed restriction orifices which have a fuel flow cross-sectional area smaller than the area over which the orifices in the rotor and the control member are communicated, whereby the amount of each fuel charge to the engine is solely dependent upon the duration of the communication between the orifices in the rotor and the control member.

5 Claims, 6 Drawing Figures

FUEL INJECTION SYSTEM FOR AN INTERNAL COMBUSTION ENGINE

CROSS REFERENCE TO RELATED APPLICATION

This application is generally related to our copending application titled "a fuel injection system for an internal combustion engine" Ser. No. 881,846, filed Feb. 27, 1978 now abandonded. All the disclosure in the earlier application is incorporated herein by reference.

BACKGROUND OF THE INVENTION

1. Field of the Invention

The present invention relates to a fuel injection system for a spark-ignition internal combustion engine which is operative to mechanically meter a liquid fuel and intermittently deliver the metered fuel to the engine.

2. Description of the Prior Art

Systems of various types and structures have been proposed for injecting a fuel such as gasoline into internal combustion engines. The heretofore-known types of fuel injection systems include an intermittent injection type in which a fuel is metered by a Jerk type fuel injection pump having a controller comprising a three dimensional cam operative in response to variations in the engine operation speed and in the degree of throttle valve opening to control the metering of the fuel and the metered fuel is delivered by injectors into branches of engine intake manifold.

The Jerk type fuel injection pump is advantageous in that the pump is operative to inject fuel at a high pressure with a resultant improvement in the atomization of the injected fuel. With this type of fuel injection pump, however, the control of the amounts of fuel to be injected into an associated engine depends not upon direct detection of the rate of air flow into the engine but indirectly upon the detection of the engine speed and the throttle valve position. The injection system of the type concerned has a difficulty that the accuracy of the air-fuel ratio control is lowered during use due partly to the wear of components which form mechanical connections and due partly to wear in the engine. In case where a Jerk type injection pump is used with a multi-cylinder engine, the pump is required to have the same number of elements as that of the engine cylinders and, in addition, necessitates many components which must be worked with a high degree of preciseness, with a resultant increase of the cost of manufacture of the pump. Moreover, the Jerk type injection pump is large-sized and heavy-weighted and thus is difficult to install in an automobile.

U.S. Pat. No. 3,996,910 issued Dec. 14, 1976 to Masaaki Noguchi et al. (inventors of the present application) discloses a fuel injection system comprising a fuel metering and distributing device which includes a rotor and a control shaft. Fuel metering and distributing slits or orifices are formed in the control shaft and in the rotor. The orifice in the rotor is brought into overlapping relationship with successive orifices in the control shaft by the rotation of the rotor to meter and distribute the fuel to respective fuel injectors. The area over which the orifice in the rotor is overlapped with each of the orifices in the control shaft is varied in accordance with a variation in an engine operating parameter, such as the rate of engine intake air flow, to control the rate of fuel flow through the overlapped fuel metering and distributing orifices. The angle of rotation of the rotor relative to the control shaft over which angle the orifice in the rotor is communicated with each of the orifices in the control shaft is constant regardless of the rate of engine intake air flow. The fuel injection system of the described structure and arrangement is difficult to manufacture and to satisfy the requirement for the fuel metering accuracy.

SUMMARY OF THE INVENTION

It is an object of the present invention to provide an improved fuel injection system which eliminates the prior art difficulty discussed above.

It is another object of the present invention to provide an improved fuel injection system which is simple in structure and easy to manufacture and is operative to accurately meter the fuel in accordance with the rate of engine intake air flow and to intermittently deliver the metered fuel to fuel injectors.

The fuel injection system according to the present invention is adapted for use with an internal combustion engine having at least one cylinder and comprises a sensor for detecting the rate of engine intake air flow, a fuel source operative to supply a fuel under a predetermined pressure, a fuel metering device including a housing provided with a fuel inlet port connected to the fuel source and at least one fuel outlet port, and at least one fuel injector adapted to be mounted on the engine. The fuel metering device further includes a rotor mounted in the fuel metering device housing for rotation in timed relationship with the engine rotation and a control member mounted in the housing in telescopic relationship to the rotor and operatively associated with the intake air flow sensor that the control member is axially moved relative to the rotor when the rate of engine intake air flow is varied. One of the rotor and control member which is disposed inside the other defines a fuel passage which is always in communication with the fuel inlet port in the fuel metering device housing. The rotor and the control member are each provided with at least one orifice. The rotation of the rotor relative to the control member moves the orifice in the rotor into overlapping and communicating relationship with the orifice in the control member. The fuel outlet port in the housing is communicated with the fuel passage when the orifices in the rotor and control member are overlapped and communicated with each other to allow the fuel to flow from the passage through the orifices and the fuel outlet port to the injector and thus into the engine. The arrangement is such that the angle of rotation of the rotor over which the communication between the orifices in the rotor and control member lasts is varied in accordance with the variation in the rate of engine intake air flow to thereby meter a fuel charge to be fed into the engine. A fuel delivery circuit means is provided to deliver the thus metered fuel charge to the injector. The fuel delivery circuit means includes the fuel outlet port provided in the fuel metering device housing. An orifice member is disposed in the fuel delivery circuit means to provide therein a fixed restriction orifice having a fuel flow cross-sectional area smaller than the area over which the orifices in the rotor and the control member are overlapped and communicated with each other whereby the amount of each fuel charge to the engine is solely dependent upon the duration of the communication between the orifices in the rotor and the control member.

The number of the fuel injectors may preferably be equal to the number of engine cylinders. The fuel injectors may preferably be associated with the engine cylinders, respectively. The rotor may preferably be provided with a single orifice while the control member is provided with a plurality of orifices equal in number to the fuel injectors and the engine cylinders. The orifices in the control member may preferably be disposed in substantially radially and axially aligned relationship to the fuel outlet ports, respectively, and cooperate with the orifice in the rotor to meter and distribute the fuel to the fuel outlet ports and thus to the injectors.

An orifice member may preferably be removably mounted in each of the fuel outlet ports. The orifice members in respective fuel outlet ports may preferably provide substantially the same fuel flow characteristic to assure substantially uniform distribution of fuel to respective fuel injectors.

Preferably, the orifices in the rotor and the control member may be triangular.

The above and other objects, features and advantages of the present invention will be made apparent by the following description with reference to the accompanying drawings.

DESCRIPTION OF PREFERRED EMBODIMENTS

Figure 1:
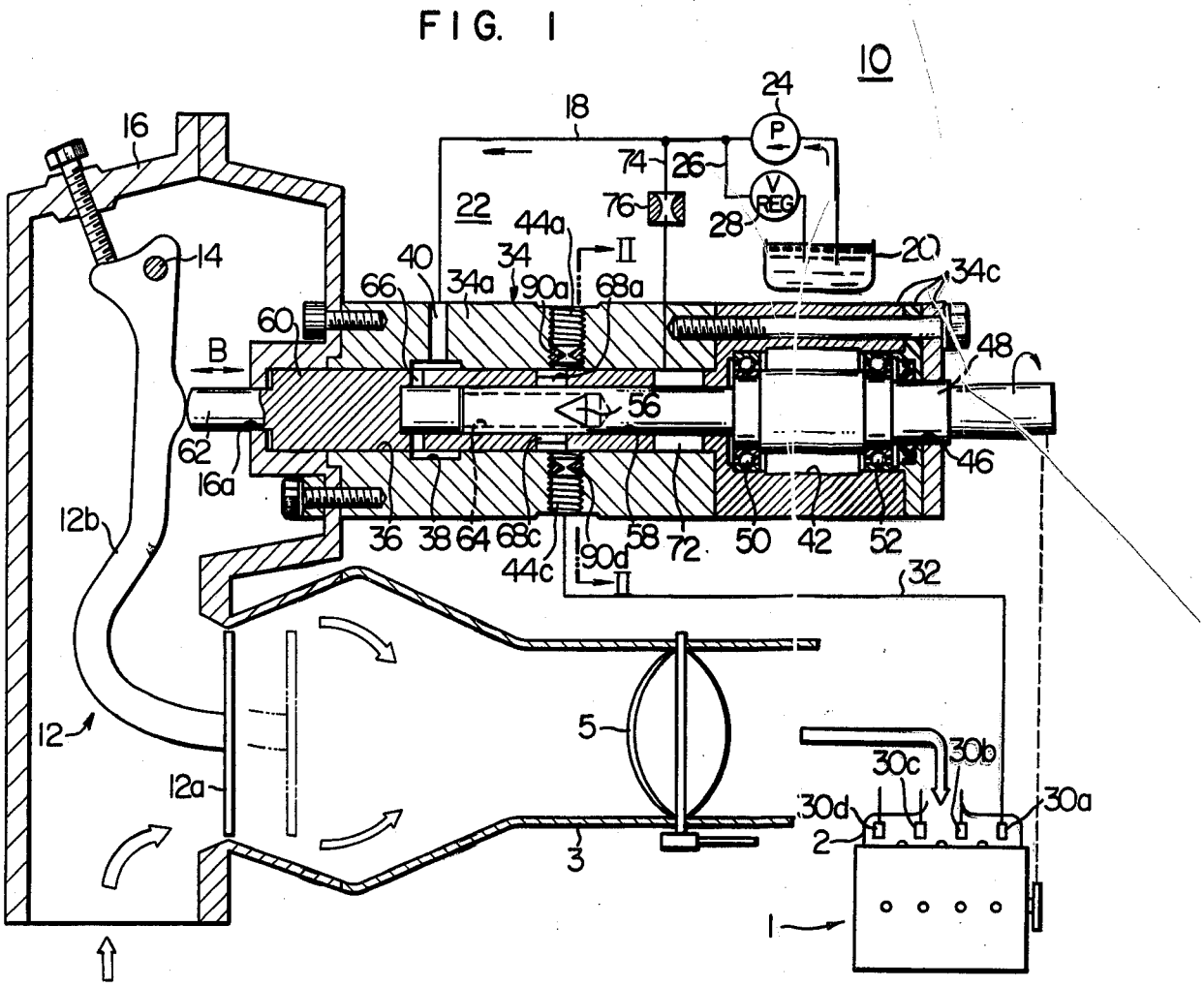
FIG. 1 is a partly sectional diagrammatic illustration of an embodiment of a fuel injection system for an internal combustion engine according to the present invention with parts shown in section being taken on line I—I in FIG. 2.
Figure 2:
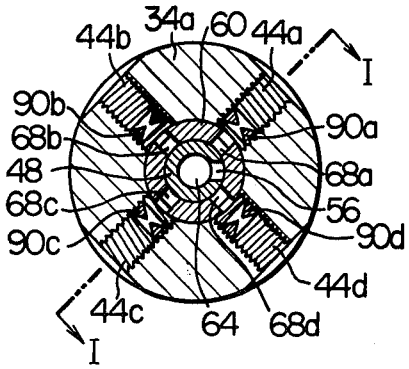
FIG. 2 is a cross-sectional view of a fuel metering and distributing device as taken on line II—II in FIG. 1.
Figure 3:
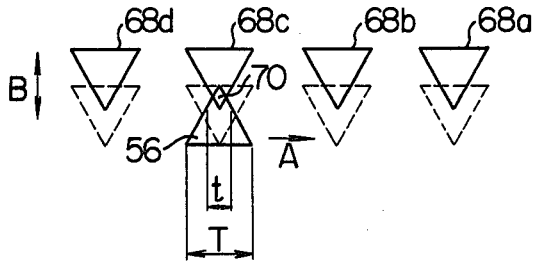
FIG. 3 illustrates in enlarged schematic development view fuel metering orifices in a rotor and a control member shown in FIGS. 1 and 2.
Figure 4:
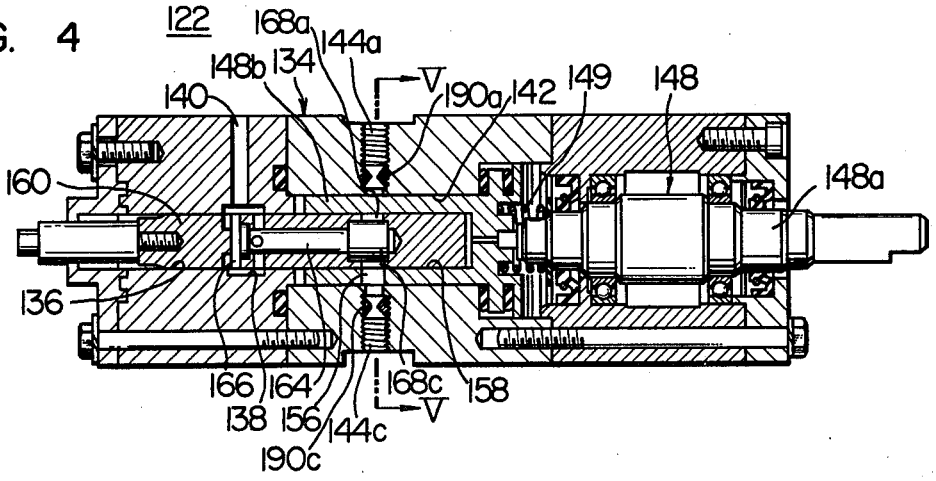
FIG. 4 is a partly sectional view of a fuel metering and distributing device of a second embodiment of the invention as taken on line IV—IV in FIG. 5.
Figure 5:
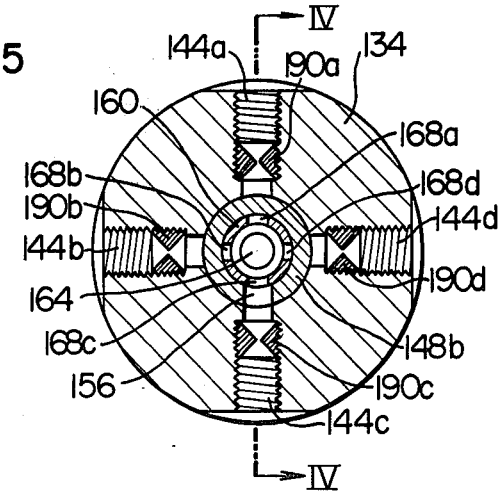
FIG. 5 is an enlarged sectional view taken on line V—V in FIG. 4.

Referring first to FIGS. 1 to 3 of the drawings, a conventional 4-stroke, reciprocal piston, spark-ignition internal combustion engine 1 is shown as having 4 cylinders and an intake manifold 2 and an intake air duct 3 upstream thereof. Air from a conventional air cleaner (not shown) flows through the intake air duct 3 and intake manifold 2 into respective engine cylinders. The air flow is controlled by a throttle valve 5 pivotally mounted in the intake air duct 3 and operated in convention manner by an engine accelerator (not shown).

A fuel injection system generally designated by 10 includes an air flow sensor 12 disposed between the air intake duct 3 and the air cleaner to detect the rate of air flow from the cleaner through the duct 3 and manifold 2 into the engine 1. The sensor 12 comprises a vane 12*a* disposed in the path of the air flow and connected to an end of a lever 12*b* which is pivotally mounted by a pin 14 in an enclosure 16 which defines therein an air passage and which receives air from the air cleaner. It will be noted that the lever 12*b* and the vane 12*a* carried thereby are rotated in counterclockwise direction about the pin 14 as the rate of air flow through the air passage into the engine 1 is increased.

The fuel circuit of the fuel injection system 10 includes a fuel supply line 18 extending between a fuel tank 20 and a fuel delivery device or distributor 22 to be described later. An electrically actuated fuel pump 24 is provided in the fuel supply line 18 to pump the fuel from the tank 20 into the distributor 22. A fuel return line 26 is provided between the fuel tank 20 and the fuel supply line 18 downstream of the pump 24. A pressure regulator 28 is provided in the return line 26 and uses either the atmospheric pressure or the engine intake manifold vacuum as a reference pressure to release surplus fuel from the supply line 18 through the return line 26 back into the tank 20 so that the fuel in the supply line 18 is kept at a substantially fixed constant pressure.

The distributor 22 is operative to meter and distribute the fuel from the fuel supply line 18 to fuel injectors 30*a* through 30*d* mounted on respective branches of the engine intake manifold 2, through fuel delivery lines only one of which is shown in FIG. 1 by reference numeral 32. The distributor 22 comprises a generally cylindrical housing 34 rigidly mounted on the enclosure 16. The housing 34 includes a generally cylindrical hollow main part 34*a* bolted at one end to the enclosure 16 and a right end part 34*c* secured to the main part 34*a* by bolts to complete the housing 34. The main part 34*a* of the housing 34 defines therein a generally cylindrical axial bore 36 having an inner peripheral surface in which an annular groove 38 is formed. A single fuel inlet port 40 connected to the fuel supply line 18 extends radially through the wall of the housing part 34*a* to the annular groove 38. The right end housing part 34*c* defines therein a generally cylindrical bore 42 extending in coaxial relationship with the axial bore 36 in the main housing part 34*a*. As will be best seen in FIG. 2, a circumferential row of four fuel outlet ports 44*a* to 44*d* is provided in the peripheral wall of the housing part 34*a*. These ports are arranged at intervals of 90 degrees, respectively, and connected respectively to the fuel injectors 30*a* to 30*d* through the fuel delivery lines one of which is shown by 32.

Annular orifice members 90*a* to 90*d* are removably screwed into the fuel outlet ports 44*a* to 44*d* to provide fixed restriction orifices therein, respectively. These orifice members are precisely worked to provide substantially the same fuel-flow areas so that the flow of the fuel per unit of time through the respective fuel outlet ports are made substantially the same.

An axially elongated rotor 48 is rotatably mounted in the bore 42 in the housing end part 34*c* by a pair of axially spaced bearings 50 and 52 and has an end projecting through an opening 46 in the right end of the housing part 34*c*. This projecting end of the rotor 48 is adapted to be connected to a circular rotary member which may be in the form of a pulley or sprocket wheel (not shown) which is drivingly connected by an endless belt or chain to the output shaft of the engine 1 so that the rotor 48 is driven in timed relationship with the engine rotation. The arrangement is such that the rotor 48 is driven one revolution while the engine crank shaft (not shown) is rotated two revolutions. The left end portion of the rotor 48 defines therein an axial fuel passage 64 open in the left end face of the rotor 48. An orifice in the form of a substantially triangular opening 56 is formed in and radially extends through the peripheral wall of the rotor 48.

A cylindrical control shaft 60 is axially slidably received in the axial bore 36 in the main housing part 34*a* and has a hollow right end portion defining therein an axial bore 58 in which the left end portion of the rotor 48 is received for rotation relative to the shaft 60. The control shaft 60 is supported so as not to be rotated by the rotation of the rotor 48 but axially movable relative to the rotor 48. The control shaft 60 is connected at its left end to a plunger 62 which slidably extends out of the bore 36 and through an opening 16*a* in the enclosure 16 into slidable engagement with the lever 12*b* of the air flow sensor 12 so that, when the lever 12*b* is rotated counterclockwise by the increase in the engine intake air flow rate, the plunger 62 is pushed rightwards to move the control shaft 60 axially rightwards. The fuel passage 64 in the rotor 48 is always in communication with the annular groove 38 through the bore 58 and through fuel inlets 66 formed in the peripheral wall of the control shaft 60 in axial alignment with the groove 38. The control shaft 60 is further provided with a circumferential row of four triangular orifices 68*a* to 68*d* formed at substantially equal circumferential intervals in the peripheral wall of the shaft in generally axial alignment with the orifice 56 so that the rotation of the rotor 48 moves the orifice 56 successively into overlapping and communicating relationship with the orifices 68*a* to 68*d*. These latter orifices are substantially radially and generally axially aligned with the fuel outlet ports 44*a* to 44*d*, respectively.

The triangular orifices 56 and 68*a* to 68*d* are disposed such that each of these orifices has one side extending substantially in circumferential direction of the rotor 48 and the control shaft 60 and such that the apex of the triangular orifice 56 remote from the circumferential side thereof and the apex of each of the triangular orifices 68*a* to 68*d* remote from the circumferential side thereof are overlapped with each other when the orifice 56 is moved in the direction indicated by an arrow A in FIG. 3.

A chamber 72 is defined in the axial bore 36 between the right end of the control shaft 60 and the left end of the right end housing part 34*c*. Fuel under pressure is introduced into the chamber 72 through a fuel pressure line 74, in which a fixed restriction 76 is provided, to hydraulically exert a return or leftward force to the control shaft 60.

In operation, the liquid fuel pumped up from the tank 20 into the fuel supply line 18 is kept at a substantially constant pressure by the pressure regulator 28 and enters the distributor 22 through the fuel inlet port 40 from which the fuel flows through the annular groove 38 and the fuel inlets 66 in the control shaft 60 into the axial fuel passage 64 in the rotor 48.

The rotation of the rotor 48 successively brings the orifice 56 into communication with the orifices 68*a* to 68*d*. For example, when the orifice 56 is moved into communication with the orifice 68*a*, the fuel will flow from a fuel passage 64 in the rotor 48 through the overlapped orifices 56 and 68*a* and through the associated fuel outlet port 44*a*. Thus, the fuel is fed to an associated fuel injector and injected thereby into an associated branch of the engine intake manifold 2.

The rotor 48 is rotated one revolution during two revolutions of the engine crank shaft. Because the control shaft 60 and the housing part 34*a* are provided with a set of four orifices 68*a* to 68*d* and a set of four fuel outlet ports 44*a* to 44*d*, respectively, the distributor 22 is operative to distribute the fuel to each of the fuel outlet ports 44*a* to 44*d* and thus to the associated fuel injector one time per two revolutions of the engine crank shaft. With a 4-stroke engine, one cycle of engine operation consists of two crank shaft revolutions (with a 2-stroke engine, one cycle of engine operation consists of one crank shaft revolution and thus the rotor 48 will have to be rotated one revolution per each crank shaft revolution). Thus, the illustrated embodiment of the invention is operative to intermittently deliver the fuel to each of the engine intake manifold branches during an appropriate stroke of the associated engine cylinder.

FIG. 3 diagrammatically illustrates the cooperation of the orifices 56 and 68*a* to 68*d* to meter and distribute the fuel due to the rotation of the rotor 48 relative to the control shaft 60 and the distributor housing part 34*a* and due to the axial movement of the control shaft 60 relative to the rotor 48. It will be noted that the rotation of the rotor 48 moves the orifice 56, as indicated by an arrow A in FIG. 3, successively into overlapping and communicating relationship with the series of the orifices 68*a* to 68*d* to meter and distribute the fuel to fuel outlet ports 44*a* to 44*d*. The control shaft 60 is axially reciprocally movable with respect to the rotor 48, as indicated by a double-headed arrow B in FIG. 1, in accordance with the variation in the rate of air flow into the engine so that a "communication lasting angle" over which the orifice 56 is kept in overlapping and communicating relationship with each of the orifices 68*a* to 68*d* is varied whereby the metering of the fuel to be distributed to respective injectors 30*a* to 30*d* is controlled in accordance with the rate of engine intake air flow.

More specifically, the area 70 over which the orifice 56 in the rotor 48 is overlapped with each of the orifices 68*a* to 68*d* is sufficiently larger than the fixed restriction orifices provided by the orifice members 90*a* to 90*d* in respective fuel outlet ports 44*a* to 44*d* so that the variation in the area of overlap between the orifice 56 and each of the orifices 68*a* to 68*d* due to the axial displacement of the control shaft 60 relative to the rotor 48 does not vary the flow of the fuel per unit of time through the orifice members 90*a* to 90*d*. It is the variation in the "communication lasting angle" (or the time period during which the communication between the orifice 56 and each of the orifices 68*a* to 68*d* is continued) that changes the flow of the fuel through the fixed restriction orifices 90*a* to 90*d*. Thus, the metering of the fuel to be distributed to the injectors 30*a* to 30*d* is properly controlled in accordance with the variation in the rate of engine intake air flow.

FIG. 3 illustrates in schematic development view the orifices 56 and 68*a* to 68*d*. It will be seen that the "communication lasting angle" is varied by the axial movement of the control shaft 60 relative to the rotor 48. When the control shaft 60 is in a position to place the orifices 68*a* to 68*d* in the position shown by the solid lines, the duration of the communication of the orifice 56 with each of the orifices 68*a* to 68*d* caused by the rotation of the rotor 48 in the direction indicated by the arrow A is indicated by "t". The orifices 68*a* to 68*d* are axially movable relative to the rotor 48 by the axial displacement of the control shaft 60, as indicated by the arrow B. When the orifices 68*a* to 68*d* are moved from the solid line positions to the broken line positions due to the increase in the rate of engine intake air flow, the duration of the communication of the orifice 56 with each of the orifices 68*a* to 68*d* is increased to "T". The flow of the fuel through the overlapped orifices is continued for the increased time "T" with a resultant increase in the fuel supply to respective injectors.

Thus, it will be appreciated that the fuel metering and distributing device 22 of the described and illustrated embodiment of the invention is simple in structure, easy to precisely manufacture and reliably operative to accurately meter the fuel and distribute the fuel at correct timings to respective fuel injectors.

It will be noted that the annular orifice members 90*a* to 90*d* can be selected from those separately prepared so that the set of four orifice members mounted on the distributor 22 provide substantially the same flow characteristics. The use of the fixed restriction orifice members in the fuel outlet ports in combination with the fuel metering orifices formed in the rotor and control shaft is effective to more uniformly distribute the fuel to respective engine cylinders as compared with the case where the metering orifices in the rotor and control shaft are solely used for the metering and distribution of the fuel. In addition, by employing annular orifice members 90*a* to 90*d* which provide small fixed restriction orifices in the fuel outlet ports 44*a* to 44*d*, the orifices 56 and 68*a* to 68*d* can be relatively large-sized with a resultant increases in the freedom in the choice of methods of accurately work these orifices.

A second embodiment of the invention is illustrated in FIGS. 3 to 6 wherein parts similar to those of the first embodiment are designated by similar reference numerals added by one hundred. The embodiment includes a fuel distributor 122 which is somewhat different from the distributor 22 of the first embodiment in that a rotor 148 extends and surrounds a part of a control shaft 160 rather than extending into the control shaft as in the first embodiment. The rotor 148 comrises a first or right end part 148*a* extending out of a distributor housing 134 and adapted to be drivingly connected to an output shaft of an associated internal combustion engine (not shown). A second part 148*b* of the rotor 148 is rotatably disposed in a bore 142 in the housing 134 and drivingly connected to the first rotor part 148*a* by means of a key and groove joint which is surrounded by a compression coil soring 149 extending between the two rotor parts 148*a* and 148*b* to resiliently bias the inner rotor part 148*b* leftwards away from the outer rotor part 148*b* so that the inner rotor part 148*b* is placed in a substantially fixed axial position relative to the control shaft 160.

Figure 6:
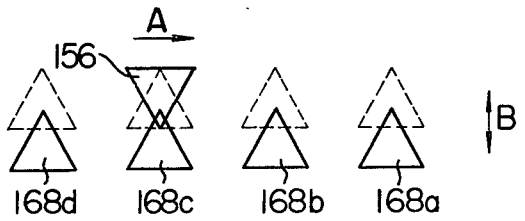
FIG. 6 is an enlarged schematic development view of fuel metering and distributing orifices shown in FIGS. 4 and 5.

The inner rotor part 148*b* is hollow and defines therein an axial bore 158 in which a right or inner end part of the control shaft 160 is received for axial movement relative to the rotor part 148*b*. The control shaft 160 defines therein an axial fuel passage 164 which is communicated with an annular groove 138 and a fuel inlet port 140 in the housing 134 through radial fuel inlets 166 formed in the control shaft 160. The control shaft 160 is provided with a circumferential row of four triangular orifices 168*a* to 168*d*, as best shown in FIG. 6. The inner rotor part 148*b* is provided with a single triangular orifice 156 which is moved into overlapping and communicating relationship with successive orifices 168*a* to 168*d*, as in the first embodiment, in a direction indicated by an arrow A in FIG. 6. The control shaft 160 is axially movable relative to the rotor part 148*b*, as in the first embodiment, when the rate of the engine intake air flow is varied. Thus, the orifices 168*a* to 168*d* formed in the control shaft 160 are moved relative to the orifice 156 in the rotor 148, as indicated by an arrow B in FIG. 6. Thus, the orifices 156 and 168*a* to 168*d* cooperate to meter and distribute the fuel to respective fuel outlets 144*a* to 144*d* formed in the housing 134 in a manner similar to that discussed in connection with the first embodiment. Annular orifice members 190*a* to 190*d* are removably screwed into the fuel outlets 144*a* to 144*d* for the same reason as in the first embodiment. The second embodiment of the invention, therefore, provides an operation similar to that of the first embodiment.

In the illustrated and described embodiments of the invention, the control shaft is mechanically associated with a member of air flow sensor which is moved when the rate of engine intake air is varied. The movement of the movable member of the air flow sensor may alternatively be transformed into a hydraulic pressure signal by which the control shaft is axially moved. The working medium may consist of the fuel. Further alternatively, the rate of engine intake air may be electrically detected by means of a conventional air flow sensor which emits an electric signal by which either a solenoid or a servo motor is actuated to axially move the control shaft. In the further alternative case, the operating parameter for the system of the invention may include not only the rate of engine intake air flow but also other engine operating parameter such as the temperature of engine cooling water.

What is claimed is:

1. A fuel injection system for an internal combustion engine having at least one cylinder, said system comprising:

a sensor for detecting the rate of engine intake air flow;

a fuel source operative to supply a fuel under a predetermined pressure;

a fuel metering device including a housing provided with a fuel inlet port connected to said fuel source and at least one fuel outlet port; and at least one fuel injector adapted to be mounted on the engine;

said fuel metering device further including a rotor mounted in said housing for rotation in timed relationship with the engine rotation and a control member mounted in said housing in telescopic relationship to said rotor and operatively associated with said intake air flow sensor so that said control member is axially moved relative to said rotor when the rate of engine intake air flow is varied;

one of said rotor and control member which is disposed inside the other defining a fuel passage always in communication with said fuel inlet port in said housing;

said rotor being provided with at least one orifice;

said control member being provided with at least one orifice;

the rotation of said rotor relative to said control member moving the orifice in said rotor into overlapping and communicating relationship to the orifice in said control member;

the arrangement being such that the angle of rotation of said rotor over which the communication between said orifices lasts is varied in accordance with the variation in the rate of engine intake air flow to thereby meter a fuel charge to be fed into the engine;

said fuel outlet port in said housing being communicated with said fuel passage when said orifices are overlapped and communicated with each other to allow the fuel to flow from said fuel passage through said orifices and said fuel outlet port;

a fuel delivery circuit means for delivering the thus metered fuel charge to said fuel injector;

said fuel delivery circuit means including said fuel outlet port in said fuel metering device housing; and an orifice member disposed in said fuel delivery circuit means to provide therein a fixed restriction orifice having a fuel flow cross-sectional area smaller than the area over which said orifices are overlapped and communicated with each other, whereby the amount of each fuel charge to the engine is solely dependent upon the duration of the communication between said orifices in said rotor and said control member, wherein the orifice in said rotor and the orifices in said control member are all triangular and arranged such that an apex of the orifice in said rotor and an apex of each of the orifices in said control member are overlapped with each other when the orifice in said rotor is moved by the rotation of said rotor relative to said control member.

2. A fuel injection system according to claim 1, wherein the engine is of a multi-cylinder type and a plurality of injectors are provided for respective engine cylinders, and wherein said housing is provided with a plurality of fuel outlet ports equal in number to said injectors and connected thereto, respectively, and said rotor is provided with a single orifice while said control member is provided with a circumferential row of a plurality of orifices equal in number to said fuel outlet ports, the orifices in said control member being disposed at points generally radially and axially aligned with said fuel outlet ports, respectively, the orifice in said rotor being moved by the rotation of said rotor into overlapping and communicating relationship with successive orifices in said control member so that said fuel passage is successively communicated with said fuel outlet ports whereby the fuel is distributed to respective injectors at different time phases.

3. A fuel injection system according to claim 2, wherein the orifice member is removably mounted in each of said fuel outlet ports, and wherein the orifice members in the respective fuel outlet ports provide substantially the same fuel flow characteristic to assure substantially uniform distribution of fuel to respective fuel injectors.

4. A fuel injection system according to claims 1, 2 or 3, wherein said rotor has a portion disposed between said control member and said housing.

5. A fuel injection system according to claim 1, 2 or 3, wherein said rotor has a portion disposed inside said control member.

* * * * *